United States Patent [19]

Parkinson

[11] Patent Number: 5,035,065

[45] Date of Patent: Jul. 30, 1991

[54] METHOD AND APPARATUS USING MOLECULAR SIEVES FOR FREEZE DRYING

[76] Inventor: Martin C. Parkinson, 6 N. Delaware Dr., Nyack, N.Y. 10960

[21] Appl. No.: 446,616

[22] Filed: Dec. 6, 1989

Related U.S. Application Data

[63] Continuation of Ser. No. 202,142, Jun. 3, 1988, abandoned.

[51] Int. Cl.[5] ..... F26B 13/30

[52] U.S. Cl. ..... 34/92; 34/5; 55/389; 55/73

[58] Field of Search ..... 34/5, 92; 55/389, 73

[56] References Cited

U.S. PATENT DOCUMENTS

| | | | |
|---|---|---|---|
| 3,501,897 | 3/1970 | Van Helden et al. | 55/73 |
| 3,722,189 | 3/1973 | Tourtellotte | 55/389 |
| 4,561,191 | 12/1985 | Parkinson | 34/92 X |

*Primary Examiner*—Albert J. Makay
*Assistant Examiner*—John Sollecito
*Attorney, Agent, or Firm*—Martin Parkinson

[57] ABSTRACT

An apparatus and method is described for sequestering sublimating water vapor with molecular sieves during freeze drying. Long mesh columns of sieves permit unimpeded sublimating water vapor flow while efficiently adsorbing sublimating water vapor at high flow rates, and also allow efficient sieve desorption during regeneration.

2 Claims, 2 Drawing Sheets

METHOD AND APPARATUS USING MOLECULAR SIEVES FOR FREEZE DRYING

This application is a continuation of Ser. No. 07/202,142, filed on Jun. 3, 1988, now abandoned.

BACKGROUND OF THE INVENTION

This invention relates to an improved method and apparatus for the utilization of molecular sieves in freeze drying.

Freeze drying is now considered a basic method for the high quality preservation of pharmaceuticals such as vaccines, vitamin preparations, hormones, antibiotics, recombinant DNA products and the like. The food industry finds the method useful for dried convenience foods such as instant coffee, and field rations for the military or for sportsman. Freeze drying involves solidly freezing a high water content material, and then subjecting the frozen material to a high vacuum and controlled heating until substantially all of the original water content is removed. The water is removed via sublimation, i.e. ice goes directly to water vapor, bypassing the intermediary liquid phase. Results are usually a high quality dried product that can be quickly and easily reconstituted to virtually the original product by simply adding water In standard freeze drying techniques it is necessary to eliminate the sublimating water vapor before it gains entrance to the oil-sealed vacuum pump, since water condensing in the pump oil rapidly causes an unacceptably high pressure rise within the vacuum pump, and hence the entire system. To prevent this, water vapor is frozen out on cold surfaces which are routinely refrigerated by means of mechanical refrigeration compressors, which make use of recirculated refrigerants such as "Freon" (a registered trademark of E. I. duPont deNemours & Co.).

Materials to be freeze dried almost always have to be maintained at temperatures below the freezing point of water during freeze drying, i.e. 0° C., as, for example, −10° C., −20° C. or even lower temperatures. The reason for this is that these materials often contain salts and sugars which give them low "eutectic temperatures", i.e. temperatures at which they are solidly frozen. Above these temperatures these materials might appear be frozen, but small, unfrozen pockets would remain. These pockets would evaporate rather than sublimate during freeze drying, yielding poor to unacceptable results. To enable the frozen material undergoing freeze drying to sublimate at these low temperatures places a second burden on the refrigeration compressors. They must not only efficiently freeze out the sublimating water vapor, but also maintain this ice condensate at a low enough temperature so that the ice within the frozen product (naturally at a warmer temperature than the condensed ice) remains at an acceptably low limit. To do this the mechanical refrigeration compressors must operate at unusually low temperatures of −40° C. or even substantially lower. At these low temperatures mechanical refrigeration compressors tend to be inefficient, and are prone to premature mechanical difficulties.

In a previous application (Ser. No. 738,378, filed May 28, 1985, now U.S. Pat. No. 4,561,191, the disclosure of which is hereby incorporated by reference) I describe a method and apparatus for continuous freeze drying using molecular sieves in place of mechanical refrigeration for sequestering the sublimating water vapor, resulting in increased operational efficiencies and equipment reliablility. However in the preferred embodiment of U.S. Pat/ No. 4,561,191 it is necessary to place the molecular sieves in solid wall metal holders in order to control exothermic heat dissipation during freeze drying, and to assist heat transfer to the sieves during regeneration. It is also necessary to have these metal holders be relatively short and narrow in order to facilitate regeneration of the sieves by heat regeneration without the use of a purge gas. This requires a large number of solid wall metal holders for the molecular sieves, which adds to the complexity and expense of fabricating condensers containing these molecular sieves. Since the molecular sieves are packed solidly in these holders sublimating water vapor flow is impeded, thereby placing relatively low limits on the rate of water vapor flow permissible when low temperatures of the ice within the sample being freeze dried, e.g. −10° C., is required for high quality preservation of the sample. Also, the surface area of molecular sieves within solid wall holders which is quickly available to the sublimating water vapor (for purposes of sequestering said water vapor) is greatly limited. Further, the ability to have the water vapor migrate in all directions, and in particular in the opposite direction from the normal flow of the non-condensable gases (which will be discussed further), is virtually eliminated in the "fully packed" molecular sieve holder configuration.

SUMMARY OF THE INVENTION

The present invention overcomes these difficulties, and provides improved molecular sieve performance in freeze drying applications.

Molecular sieves are solid, regenerable chemical desiccants, the manufactured form used in this invention being commonly referred to as synthetic zeolites. They are commercially available usually according to the pore size of their cage like structure. Type 3A (3 angstrom unit pore size) and Type 4A (4 angstrom unit pore size) are preferred for freeze drying, especially in the commonly supplied ⅛" pellet size. Type 3A is particularly useful since residual non-condensable gases within this sieve are released with unusual speed and efficiency when it is subjected to a vacuum.

Typical applications for molecular sieves involve packing sieves either in powder, bead or pellet form into columns so that the gas or liquid to be treated by the sieves is assured intimate contact with all parts of the sieve bed. In my original research (using molecular sieves for continuous freeze drying) I also assumed this "packed" sieve bed configuration was necessary. For example, when 90 grams of Type 3A sieve is placed in a one foot long by one inch wide copper tube, and this tube is connected between a freeze dry flask containing 120 ml. of ice, and a 25 liter/minute, two stage vacuum pump, 9 grams or more of water is adsorbed by this sieve (10% or more adsorption efficiency) while maintaining the ice within the freeze dry flask in a solidly frozen condition. In an attempt to improve the heat regeneration characteristics of this sieve column I then placed 83 grams of Type 3A sieve in a 10"×1" open copper mesh column, and then this column was placed within a solid wall copper tube measuring 12"×1.5". This tube was then connected between a freeze dry flask containing 120 ml. of ice and a 25 liter/minute, two stage vacuum pump as in the previous experiment. This time, however, failure was immediate. Sublimating water vapor simply by-passed the sieve, creating an immediately unacceptable high pressure. Attempts to improve adsorption in this open mesh column by placing a small "starter" quantity of Type 3A sieve at the base of the solid wall copper tube, or by placing quantities of aluminum foil down the open sides of this tube to increase impedance to water vapor flow, proved unsuccessful. This concept was therefor abandoned at that time in favor of the solid wall, sieve packed tube.

Recently I have discovered that molecular sieves can be placed in long, open mesh columns, while at the same time significantly improving the adsorption and desorption functions of the sieves in freeze drying. For example, 40 grams of Type 3A sieve placed within an open aluminum mesh column held within a 6"×2" solid wall copper tube satisfactorily adsorbed 4.4 grams of sublimating water vapor (emanating from a freeze dry flask containing 60 ml. of ice) when connected in series with three solid wall copper tubes (each measuring 6"×1", and each containing 40 grams of Type 3A sieve) and a 25 liter/minute, two stage vacuum pump. A similar experiment in which two 6"×2" solid wall copper tubes, each containing Type 3A sieve in open mesh columns, connected alternatively in series with two 6"×1" solid wall copper tubes filled with Type 3A sieve also resulted in satisfactory adsorption of water vapor within the two open mesh columns.

These results led to the following experiment which proved that a virtual direct "line of sight" can exist for the sublimating water vapor within a freeze drying flask and the inlet to the vacuum pump being used to create the necessary vacuum , yielding significant molecular sieve adsorption and desorption advantages. This experiment consisted of: (1) Placing 85 grams of Type 3A sieve (⅛" pellets) within an open aluminum mesh column measuring 10"×1.5", and placing this column within a solid wall 12"×2" copper tube; (2) Placing 45 grams of Type 3A sieve (⅛" pellets) within an open mesh aluminum column measuring 5"×1", and placing this column within a solid wall 6"×1.5" copper tube; (3) Placing 45 grams of Type 3A sieve (⅛" pellets) in an arrangement identical to point (2); (4) Connecting all three solid wall copper tubes in series to a 25 liter/minute, two stage vacuum pump; and (5) Connecting a freeze drying flask containing 60 ml. of ice to the 12"×2" solid wall copper tube. The results were an efficient adsorption of 16.6 grams of water at a flow rate of approximately 4.4 ml. per hour, at an ice (within the freeze dry flask) temperature of −15° C. These three sieve columns also regenerated extremely well under the relatively mild heat of 500° F. for a two hour time period. In comparable experiments using similar quantities of Type 3A sieve (⅛" pellets contained in four 6"×1" solid wall copper tubes in the amount of 40 grams of sieve per tube) ice ( within the freeze dry flask) temperatures were usually of the order of −5° C. or warmer at these relatively high flow rates. In addition regeneration of these sieves at these mild temperature conditions of 500° F. (an extremely important consideration since molecular sieves rapidly lose water adsorption efficiency if heated substantially above this temperature) is not as complete.

I find that superior molecular sieve freeze drying results with the virtual elimination of solid wall sieve holders, and the concept of a "packed" bed of molecular sieves. The sieves instead are placed in relatively long and narrow open mesh columns, which are separated from each other, but are in vapor communication with each other. When these mesh columns are placed within a vacuum impervious container and sublimating water vapor is introduced to this container under vacuum, the water vapor is free to migrate in virtually any direction and over an unusually great length. If there are periodic "packed" beds of sieve (to add impedance to the system),or, more efficiently, if the effective length of the sieve extends at least one and one half feet along the normal pathway vapors generally take within the container, excellent water vapor adsorption occurs.

There are numerous advantages inherent in this invention. Since solid wall metal sieve holders are largely (or completely) eliminated condenser fabrication is made simpler and more economical. Also there is much greater flexibility as to the size, shape, and placement of the molecular sieve open mesh columns.

Another advantage is the attainment of substantially colder ice (sample) temperatures, which are obtainable at higher water vapor flow rates per unit of molecular sieve. This is related to the greatly increased sieve surface area that is immediately available for water vapor adsorption.

Another advantage is the unique, new way exotherm is controlled. Water vapor condensing within the molecular sieves causes them to rapidly heat up and thereby lose water vapor condensing capacity. Also the vapor pressure equilibrium rises in relation to the sublimating water vapor, which limits the ice (sample) temperature to relatively warm temperatures which may be unacceptable for certain materials being freeze dried, or even causing melting of the ice (sample). In the open mesh column configuration of this invention, as hot areas (and therefore high pressure areas) develop during water vapor adsorption, the water vapor is free to migrate to lower pressure areas, thereby largely by-passing the negative effects on freeze drying imposed by this exothermic heating.

A further advantage is the superior heat regeneration of the sieves even at lower heating temperatures and using longer and thicker columns of sieve. Lower heating temperatures of the order of 500° F. or less are highly desirable for the long term stability of molecular sieves, especially for water adsorption and desorption operations. Instead of forcing water vapor to be adsorbed and desorbed repeatedly as it attempts to leave a solid packed column of sieve, in this invention the average distance the water vapor traverses before it escapes from the sieve is greatly shortened, since water vapor can leave the sieve over its entire length, as well as by means of the top and bottom areas. This desorption efficiency is especially important for this invention which does not make use of a purge gas during regeneration.

Still another advantage is the permissible feature of back migration of sublimating water vapor for the purpose of sequestering said water vapor. In the present invention a relatively short section of molecular sieve can be employed in the opposite direction of the normal vapor flow within a condenser, which would not be useful in a "packed" column of sieve. During freeze drying, as high pressure areas begin to develop along the normal vapor flow, i.e. in the direction usually taken by non-condensable vapors within a condenser as they move towards the vacuum pump, water vapor is free to migrate in the opposite direction, thereby providing added adsorption efficiency, assisting the maintenance of low ice (sample) temperature at high vapor flow rates.

DESCRIPTION OF THE PREFERRED EMBODIMENT

Figure 1:
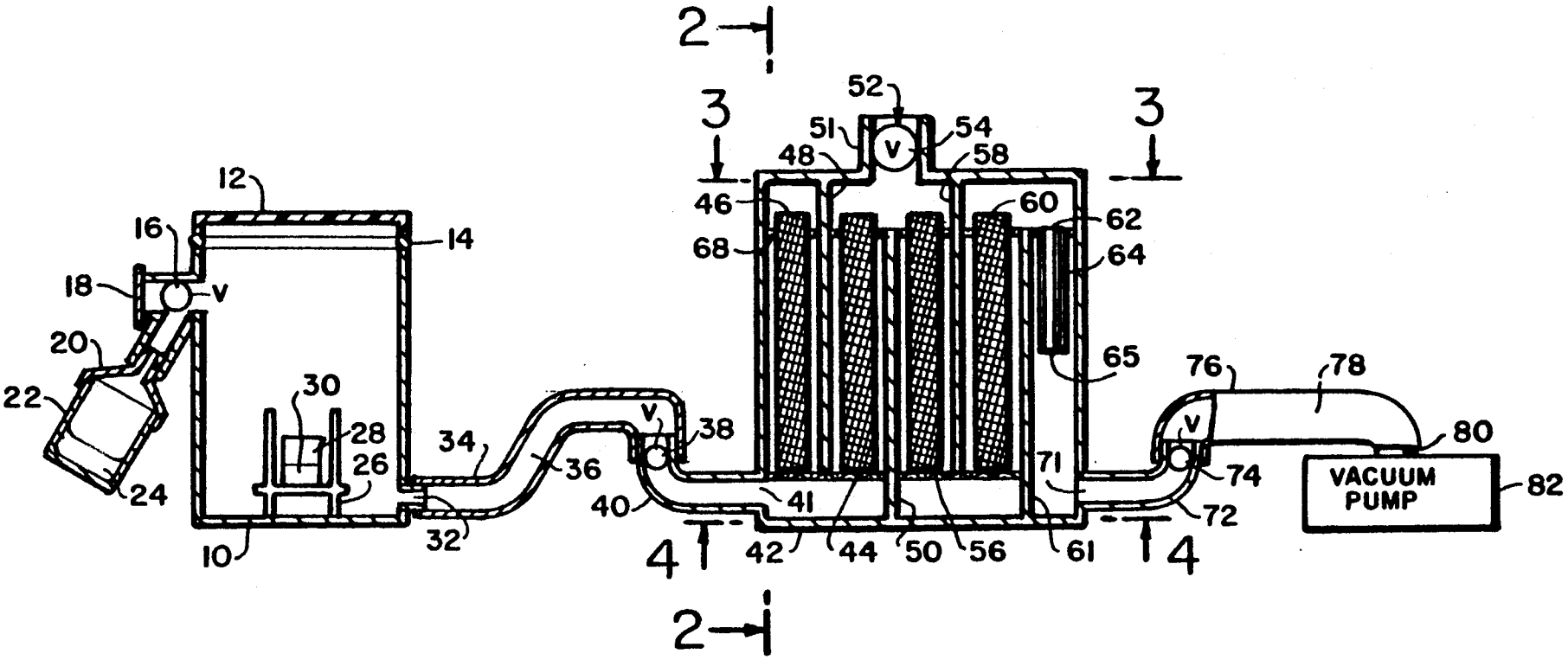
FIG. 1 is a schematic representation of one possible embodiment of the freeze drying apparatus of the invention.
Figure 2:
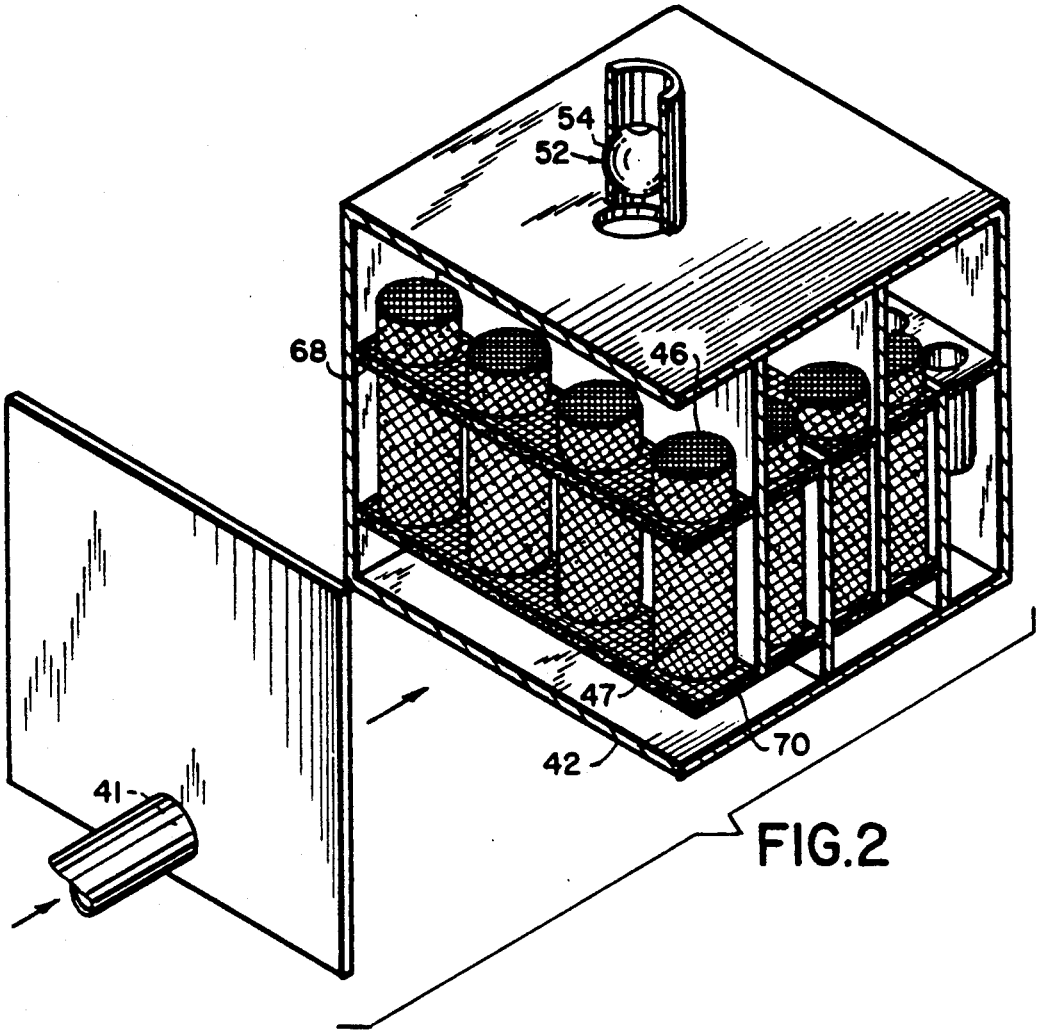
FIG. 2 is an exploded, partially sectional view of the condenser structure of the invention, taken along the line 2—2 of FIG. 1.
Figure 3:
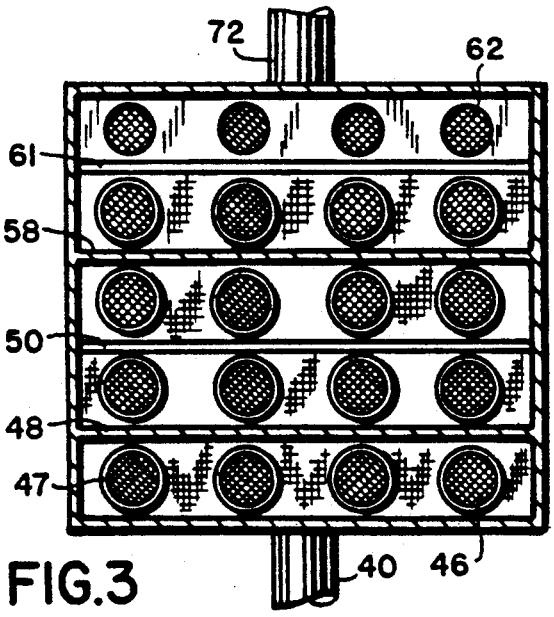
FIG. 3 is a partially sectional view of the top of the condenser structure of the invention, taken along the line 3—3 of FIG. 1.
Figure 4:
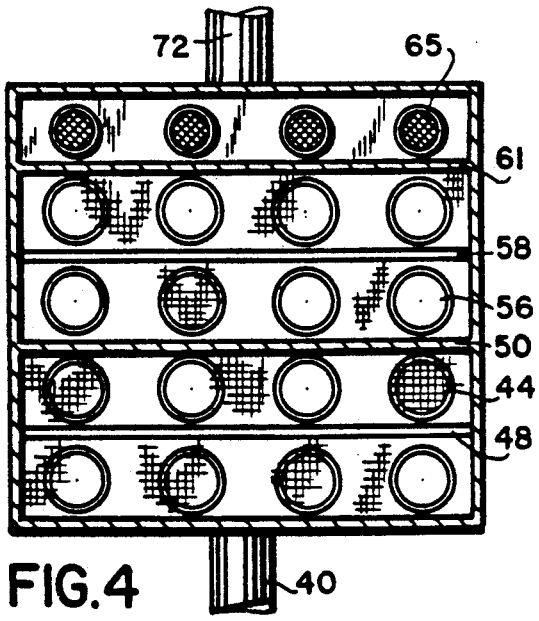
FIG. 4 is a partially sectional view of the bottom of the condenser structure of the invention, taken along the line 4—4 of FIG. 1.

Referring now to FIG. 1 a combination bulk and manifold vacuum impervious drying chamber 10 is shown. At the top of drying chamber 10 resilient gasket 14 provides a vacuum tight seal between the drying chamber and the top plate 12 (the closure for the drying chamber) during operation. Externally mounted on the drying chamber is a manually operated frozen sample valve 16. Cap 20 provides a vacuum tight seal for flask 22 and its frozen sample 24. Turning knob 18 to its open position provides a pathway for water vapor sublimating from frozen sample 24 to the interior of drying chamber 10. Within the drying chamber stand 26 provides a tray support for beaker 28 and the frozen sample 30 contained within the beaker.

Vapor outlet tube 32, located near the base of the drying chamber, is in vacuum tight communication with vapor inlet tube 40, located near the base of the molecular sieve condenser 42, by means of vacuum impervious rubber tube 34. Vapor flow within conduit 36 is controlled by valve 38 within vapor inlet tube 40.

FIGS. 1, 2, 3 and 4 illustrate the placement of the molecular sieve columns within vacuum impervious condenser 42. Molecular sieve pellets 47 substantially fill the sixteen mesh columns, such as mesh columns 46, 44, 56 and 60, as well as four solid wall holders, such as holder 64. Mesh base 70 (FIG. 2) provides the base support for all sixteen mesh columns. Securing rings (not shown) are attached to mesh base 70 to provide vertical alignment for each of the mesh columns. Mesh top 68 contains sixteen circular cut outs so as to secure all sixteen mesh columns in a spaced relationship to each other. Four divider/heater plates (nos. 48, 50, 58 and 61) within condenser 42 separate the mesh columns into groups of four within the condenser. The divider/heater plates provide the means for guiding water vapor flow during freeze drying, and also the means for heat regenerating the molecular sieves after a dehydration. For example, divider/heater plate 48 separates four mesh columns immediately adjacent vapor inlet opening 41 from a second group of mesh columns on its opposite side. This second group of four columns is separated from a third group of four columns by divider/heater plate 50, and similarly this third group of columns is separated from a fourth group of mesh columns by divider/heater plate 61. A solid plate containing four openings, such as opening 62, provides the means for securing the four solid wall holders in a vertical position in a spaced relationship to each other, and also the means for directing vapor flow through these four holders during operation.

It should be noted that although the mesh columns are described above for convenient placement within the condenser, the mesh construction for the molecular sieve columns permits a variety of other column shapes, as, for example, a single serpentine shaped mesh column of molecular sieves. Similarly, the divider/heater plate has been combined for convenience. A variety of other arrangements can be used for heating the molecular sieves, as, for example, placing heating elements around the outer wall of the condenser, or within the sieves, etc.

Located centrally at the top of condenser 42 is steam pipe 51. Within steam pipe 51 valve 54 provides the means for gaining access to the atmosphere through opening 52 during periods of molecular sieve regeneration.

Completing the vacuum system for the apparatus, vapor outlet opening 71 communicates with vapor outlet tube 72, which is in vacuum tight communication with the vapor inlet tube 80 on vacuum pump 82, by means of vacuum impervious rubber tube 76. Valve 74 within vapor outlet tube 72 provides the means for controlling vapor flow in conduit 78.

To begin a freeze drying operation, the vacuum pump is turned on, and remains on throughout the dehydration. At this time valve 54 is in closed position providing a vacuum tight seal for the condenser opening to atmosphere 52 within steam pipe 51. Valve 38 is in open position, permitting free flow of both condensable (principally water vapor) and non-condensable vapors from the drying chamber to the condenser. Valve 74 is in open position permitting free flow of principally non-condensable vapors (air) to the vacuum pump. Atmospheric pressure forces drying chamber top plate 12 securely against gasket 14, providing a vacuum tight seal. Pressure within the system now falls to 1 millimeter or less. Turning knob 18 to its open position provides a vapor pathway for sublimating water vapor originating from frozen sample 24 to gain access to the interior of the drying chamber 10, and hence to vapor outlet tube 32, conduit 36, vapor intlet tube 40, vapor inlet opening 41, and then into the interior of condenser 42. This illustrates the process of manifold freeze drying as it is commonly employed. Similarly bulk freeze drying procedures may be carried out at the same time making use of the interior of the drying chamber. Water vapor now sublimates from frozen sample 28 within beaker 30, and this vapor also migrates to vapor outlet tube 32, conduit 36, vapor inlet tube 40, vapor inlet opening 41, and hence to the interior of the condenser.

Non-condensable vapors, such as air, will be quickly evacuated from the entire system, passing through vapor outlet 71 to vapor outlet tube 72, conduit 78, vacuum pump inlet tube 80, and hence to the vacuum pump 82 which then expels these vapors to the atmosphere. Virtually all of the sublimating water vapor is sequestered by the molecular sieves within the condenser. As the water vapor enters the condenser it is immediately free to interact with a large surface area of molecular sieve, beginning with the first set of four mesh molecular sieve columns, e.g. columns 46, and also the second set of four mesh molecular sieve columns, e.g. column 44. In fact there is no major impedance to the flow of the sublimating water vapor until it encounters the four openings, e.g. opening 62, to the four solid wall molecular sieve holders, e.g. holder 64. The tendency of the sublimating water vapor is to follow the normal flow path of the non-condensable vapors, i.e. in and around the second set of mesh columns, e.g. column 44, around the top of divider/heater plate 50, in and around the third set of mesh columns, e.g. column 56, around the bottom of divider/heater plate 58, in and around the fourth set of mesh columns, e.g. column 60, around the top of divider/heater 61, and finally into the four solid wall holders through the openings to these holders, such as opening 62 to holder 64. Therefore, there is always a large linear surface area of molecular sieve available for the sequestering of sublimating water vapor along the normal pathway taken by non-condensable vapors within the condenser. It is also important to note that in this invention the water vapor is also free to migrate opposite to the direction of normal vapor flow. During freeze drying, as sublimating water vapor is adsorbed by the molecular sieves, the sieves rapidly heat up, thereby losing water adsorption capacity and creating localized high pressure areas. Under these conditions water vapor is free to back migrate to the cooler and lower pressure area of the first set of mesh sieve columns. Thus by providing a greatly enlarged surface area of molecular sieves along the normal path of water vapor migration, plus an additional area for back migration adsorption of water vapor, efficient adsorption of water vapor can occur at high water vapor flow rates, while at the same time maintaining frozen samples, such as frozen samples 24 and 28, at sufficiently low temperatures necessary for the high quality preservation of freeze dried products.

While adequate molecular sieve adsorption of sublimating water vapor does take place without significant impedance along the water vapor path, I have found adding a small amount of impedance, in the form of four relatively short packed columns of sieve in solid wall holders (e.g. holder 64), provides a gentle back pressure to the condenser, and allows a higher quantity of water vapor to be adsorbed per unit of molecular sieve. At the same time frozen sample temperatures, e.g. frozen samples 24 and 28, are not appreciably raised. Obviously many other ways of adding impedance can be employed, as, for example, using a single solid wall sieve packed holder, etc.

At the conclusion of a dehydration the vacuum pump is turned off and atmospheric air is re-admitted to the entire system in any of a number of ways, including removing flask 22 from valve 16, and manipulating knob 18 on valve 16 so as to admit air slowly or rapidly to the interior of the drying chamber, and hence to the entire system. Dried samples (freeze dried by either the bulk or manifold method) are removed from the drying chamber.

The molecular sieves within the condenser must be regenerated after they have adsorbed a quantity of water approximately equal to 10% of their own weight. Of course the sieves can be regenerated when they have less water content for various applications. Divider/-heater plates 48, 50, 58 and 60 are preferably fabricated in metal such as copper, aluminum, or stainless steel. Each plate contains an electrical heating element, and a 500° F. high limit thermostat. These are conventional heating elements such as silicone rubber heating pads equipped with 500° F. high limit thermostats. Other conventional methods of heating these plates may be employed, as, for example, a circulated heating fluid. Energizing the divider/heater plates also energizes valves 54., 38 and 74. Valve 54 is put in open position so that steam generated within the condenser is vented to the atmosphere, without the use of a purge gas, through steam pipe 51, via opening 52. Valve 38 is put in closed position to prevent water vapor from escaping into conduit 36, and valve 74 is closed to prevent water vapor contamination of the vacuum pump. These valves are conventional solenoid valves. Alternatively, a number of other valves can be employed, including manually operated valves such as large bore stopcocks. After a three hour heating period the heating elements within the four divider/heater plates are turned off, valve 52 is closed, and valves 38 and 74 are opened. After the condenser is permitted to cool down for a one hour time period the apparatus is now in condition for another freeze drying procedure.

Stainless steel is a preferred material for fabricating the drying chamber. Making the top plate for the drying chamber out of a clear plastic, such as acrylic, adds convenience in monitoring bulk drying procedures.

Since heat transfer is of great importance to the proper functioning of the molecular sieve condenser, the condenser should be fabricated out of metal such as stainless steel, aluminum or copper. Also the divider/-heater plates, mesh columns, mesh top and bottom column supports, and the solid wall holders should all be fabricated in one of these metals to assist exothermic heat dissipation during freeze drying, and heating of the molecular sieves during periods of regeneration. Small quantities (not shown) of steel or copper wool can be added to the condenser to aid heat transfer without adding significant impedance to water vapor flow during a drying operation.

For example, placing 150 grams of Type 3A molecular sieve (in the ⅛" pellet size) within each of sixteen columns such as column 46, each of said columns being fabricated in aluminum wire mesh measuring 10"×1.5" with a minimum ¼" clearance separating each column from adjacent walls and other wire mesh columns, and placing 40 grams of this same sieve in each of four solid wall holders such as holder 64, each of said solid wall holders being fabricated in 6"×1" stainless steel tubing having an aluminum screen at its top and bottom to hold in the sieve, permits sequestering 240 ml. of water during freeze drying before regeneration is required. The condenser is regenerated by energizing divider/heater plates such as divider/heater plates 48, 50, 58 and 61 so that they heat up to a maximum of 500° F., and drive out the condensed water vapor through opening 52 over a three hour time period. Allowing the condenser to cool down for a one hour time period places the condenser in a condition to be used again for another freeze dry procedure.

The mesh construction of sieve columns not only permits excellent adsorption of water vapor, but also excellent desorption during regeneration, which is essential if desorption is to occur without the use of a purge gas. For example, placing approximately 150 grams of Type 3A sieve (in the ⅛" pellet size) in each of four 10"×1.5" aluminum mesh columns, allowing the sieve to adsorb approximately 15 grams of water each, then placing these columns in four 12"×2" copper tubes, and the heating these tubes at 500° F. for 3 hours, results in the removal of the original adsorbed 15 grams of water without any necessity for a purge gas to aid in the removal of the adsorbed water. While placing the sieve in a mesh holder permits much longer sieve columns to be employed, it is still necessary to have the mesh sieve columns relatively thin, i.e. no greater than 3" in diameter, in order to obtain desorption in a reasonable time period at 500° F. without a purge gas.

The concept of adding a small amount of impedance, by means of an area within the condenser which contains molelular sieves held within a solid wall holder, makes possible more efficient utilization of the molecular sieves. In the following experiment four 10"×1.5" wire mesh columns contained 150 grams each of molecular sieve Type 3A (⅛" pellets). Two 6"×1" solid wall copper tubes were filled with 40 grams each of this same sieve. The four mesh columns were placed inside of four 12"×2" copper tubes, and these six copper tubes were connected in series between a freeze dry flask containing 240 ml. of ice, and a 25 liter/minute, two stage vacuum pump. The four mesh columns efficiently sequestered 10% of their sieve weight in water, while maintaining the ice at −15° C., at a water vapor flow rate of 10 ml. per hour. In another experiment, without the presence of the two packed copper tubes, but at the same water vapor flow rate, two of the sieve columns fell significantly below this 10% adsorption efficiency at a frozen sample temperature of −18° C.

The back migration of water vapor permitted in this invention is important in obtaining lower frozen sample sublimation temperatures at high water vapor flow rates, and extremely low frozen sample temperatures at reasonable flow rates. In the following experiment four 10"×1.5" wire mesh columns were each filled with approximately 150 grams of Type 3A molecular sieve (⅛" pellets). Each of these mesh columns were then placed in a 12"×2" copper tube. These four copper tubes were connected in series together with one 6"×1" copper tube packed with 40 grams of this same sieve. A freeze dry flask containing 240 ml. of ice was connected between the first and second of the four larger copper tubes, and a 25 liter/minute, two stage vacuum pump was connected to the open end of the 6"×1" copper tube. Under these conditions a water vapor flow rate of 10 ml. per hour was obtained. All of the sieve in four mesh columns efficiently adsorbed the sublimating water vapor, including the sieve in the first large copper tube, demonstrating that as impedance developed due to exothermic heat build-up along the normal vapor path towards the vacuum pump, sublimating water vapor back migrated into the first of the four large copper tubes. At the same time ice temperature was maintained at −20° C. for five hours. In another similar experiment at this same water vapor flow rate, but with the freeze dry flask connected only to the first of the large copper tubes, with the remainder of the copper tubes connected in series to the vacuum pump, the ice temperature fell to −15° C. within 5 hours.

Back migration also assists maintaining extremely low frozen sample temperatures when a low sample eutectic temperature requires it. In an experiment similar to the above described back migration experiment, but limiting the water vapor flow rate (by means of heat shielding the frozen sample) to approximately 2.6 ml. per hour, a frozen sample temperature of −35° C. was maintained.

Thus is can be seen that this invention improves the performance of molecular sieves in freeze drying by simplifying equipment design, facilitating sieve regeneration without the use of a purge gas, and permitting high water vapor flow rates compatible with high quality preservation of the material undergoing freeze drying.

While the present invention has been disclosed in connection with the preferred embodiments shown and described in detail, various modifications and improvements thereon will become readily apparent to those skilled in the art. Accordingly, the spirit and scope of the present invention is to be limited only by the following claims.

I claim:

1. A freeze drying apparatus utilizing molecular sieve to sequester sublimating water vapor, which comprises:

(A) A drying chamber;

(B) A water vapor condenser having means for vapor communication with said drying chamber;

(C) Said condenser contained a quantity of said molecular sieve held within a mesh column;

(D) Said condenser containing a quantity of said molecular sieve held within a solid wall container;

(E) Said solid wall container being connected in series between said mesh column and a source of vacuum;

(F) Said condenser having means for connecting said condenser to said source of vacuum;

(G) Said mesh column of molecular sieve and said solid wall container of said molecular sieve being positioned in said condenser so that when said condenser is connected to said source of vacuum, and said means for vapor communication is providing vapor communication between said condenser and said drying chamber, said sublimating water vapor is subject to impedance to the flow of said sublimating water vapor due to the presence of said solid wall container of said molecular sieve, and, as a result of said impedance, larger amounts of said sublimiting water vapor is absorbed by said sieve in said mesh column.

2. A freeze drying apparatus according to claim 1, further comprising a small quantity of said molecular sieve within said solid wall container, said small quantity of said sieve being small in comparison to the total quantity of said sieve held within said mesh column.

* * * * *